US010337222B2

(12) United States Patent
Corpuz, Jr. et al.

(10) Patent No.: US 10,337,222 B2
(45) Date of Patent: Jul. 2, 2019

(54) SHOWER DOOR ASSEMBLIES

(71) Applicant: Kohler Co., Kohler, WI (US)

(72) Inventors: Roque M. Corpuz, Jr., Sheboygan, WI (US); James L. Marlowe, Troy, TN (US); Greg L. Parris, Medina, TN (US); Andrew G. McClure, Murray, KY (US); Thomas Lilly, Kohler, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/047,183

(22) Filed: Jul. 27, 2018

(65) Prior Publication Data

US 2018/0334840 A1 Nov. 22, 2018

Related U.S. Application Data

(62) Division of application No. 14/997,721, filed on Jan. 18, 2016, now Pat. No. 10,060,168.

(60) Provisional application No. 62/104,945, filed on Jan. 19, 2015.

(51) Int. Cl.

| | |
|---|---|
| ***E05D 5/02*** | (2006.01) |
| ***E05D 7/081*** | (2006.01) |
| ***A47K 3/36*** | (2006.01) |
| ***E05D 11/06*** | (2006.01) |
| ***E05F 1/06*** | (2006.01) |

(52) U.S. Cl.

CPC ..... *E05D 5/0246* (2013.01); *A47K 3/36* (2013.01); *E05D 7/081* (2013.01); *E05D 11/06* (2013.01); *E05F 1/061* (2013.01); *E05Y 2600/10* (2013.01); *E05Y 2600/502* (2013.01); *E05Y 2900/114* (2013.01)

(58) Field of Classification Search

CPC ..... E05D 11/06; E05D 7/081; E05D 5/0246; E05Y 2900/114; A47K 3/36; A47K 2003/367

See application file for complete search history.

(56) References Cited

U.S. PATENT DOCUMENTS 3,065,498 A * 11/1962 Johnson ..... E05D 1/04 16/359
3,646,635 A * 3/1972 Stermac ..... E05D 7/04 16/239
4,070,728 A 1/1978 Herman (Continued)

FOREIGN PATENT DOCUMENTS

EP 0693607 * 1/1996 ..... A47K 2003/367
EP 2228510 9/2010

*Primary Examiner* — J C Jacyna

(74) *Attorney, Agent, or Firm* — Foley & Lardner LLP

(57) ABSTRACT

A shower door hinge assembly includes a clamp, a member, a base, a spacer, and a pin. The clamp is configured to receive a portion of a shower door. The member is coupled to the clamp, and comprises a circumferential slot. The base is configured to be coupled to a fixed structure, and defines a hole. The spacer is coupled to the base. The member is rotatably coupled to the spacer. The pin includes a first end and a second end. The first end is configured to be received in the hole of the base, and the second end is configured to be received in the circumferential slot. The pin and the circumferential slot are cooperatively configured to define an end point of rotation for the shower door.

20 Claims, 10 Drawing Sheets

(56) References Cited

U.S. PATENT DOCUMENTS

| | | | | |
|---|---|---|---|---|
| 4,953,259 | A * | 9/1990 | Frye | E05D 11/06 16/225 |
| 5,417,272 | A | 5/1995 | Marlowe | |
| 2003/0051407 | A1 * | 3/2003 | Sosa | E05D 15/507 49/193 |
| 2013/0154464 | A1 | 6/2013 | Fiori | |
| 2014/0306595 | A1 | 10/2014 | Hwang | |
| 2015/0223619 | A1 | 8/2015 | Artwohl | |
| 2015/0345203 | A1 * | 12/2015 | Vanini | E05D 3/02 16/53 |

* cited by examiner

SHOWER DOOR ASSEMBLIES

CROSS-REFERENCE TO RELATED PATENT APPLICATIONS

The present application is a Divisional of U.S. patent application Ser. No. 14/997,721, filed Jan. 18, 2016, which claims the benefit of and priority to U.S. Provisional Application No. 62/104,945, filed Jan. 19, 2015. The entire disclosures of the foregoing applications are hereby incorporated by reference herein.

BACKGROUND

The present application relates generally to shower door assemblies, and more specifically, to pivoting, self-closing shower door assemblies.

Conventional pivoting shower door assemblies include a fixed wall member that is coupled to a fixed structure, such as a portion of a shower enclosure, a wall of a building, or another fixed portion of a building. A shower door panel can be pivotably coupled to the fixed wall member via one or more bracket assemblies to enable the door panel to pivot relative to a door opening of, for example, a shower enclosure to thereby allow the ingress and egress of a user from the shower. Typically, the bracket assemblies have fixed mounting points on both the wall member and the pivoting door panel. Thus, once the door panel is pivotably coupled to the fixed wall member, the door panel cannot be adjusted to level or correct for out-of-plumb conditions (i.e., askew positioning of the door) or to adjust a lateral position of the door relative to a door opening. In addition, many shower door assemblies use a separate, external stop mechanism or a latch (e.g., a striker plate, a magnet, etc.) mounted to a portion of, for example, a shower enclosure or a wall of a building to set a rotational position or end point for rotation of the door (i.e., at a fully opened or at a fully closed door position).

Accordingly, it would be advantageous to provide a shower door assembly that includes a pivotable door and also includes independently adjustable door brackets that allow for selective adjustment of the shower door position to level or correct for out-of-plumb conditions and to adjust a horizontal position of the door relative to a door opening. Furthermore, it would be advantageous to have a shower door bracket that includes internal features to set a rotational position/end point for the door, thereby eliminating the need for separate, external stop mechanisms or latches. These and other advantageous features will become apparent to those reviewing the present disclosure and drawings.

SUMMARY OF THE INVENTION

According to an exemplary embodiment, a shower door hinge assembly includes a guide member including a generally cylindrical body, the body defining a plurality of diametrically opposed circumferential slots. The shower door hinge assembly further includes a clamp configured to receive a portion of a shower door, the clamp defining a recess configured to receive a first side of the guide member. The shower door hinge assembly further includes a base defining a plurality of openings and a spacer comprising a generally cylindrical body defining a plurality of through holes at an outer periphery thereof, a first side of the spacer configured to be rotatively received in a corresponding recess in a second side of the guide member. The shower door hinge assembly further includes a plurality of pins configured to be received in the plurality of openings of the base, extend through the plurality of through holes of the spacer, and engage a portion of the plurality of circumferential slots.

According to another exemplary embodiment, a shower door hinge assembly includes a cam comprising a plurality of diametrically opposed wings, a receiver having an upper end and a lower end, the upper end defining a planar surface, the planar surface defining a plurality of detents configured to receive the plurality of wings, a base configured to be fixedly coupled to the receiver, and a clamp configured to receive a portion of a shower door, the clamp further configured to be fixedly coupled to the cam.

According to another exemplary embodiment, a shower door assembly includes a frame, a door panel disposed within the frame, and an upper hinge assembly. The upper hinge assembly including a first clamp configured to receive an upper portion of a shower door, the first clamp having a pin and a guide sleeve projecting from an upper end thereof. The upper hinge assembly further includes a bushing configured to receive the guide sleeve and to receive the pin in an opening at an outer periphery thereof, an elongated member defining an opening configured to receive a portion of the bushing, and a circumferential slot defined around the opening of the elongated member, the circumferential slot configured to receive the pin of the clamp. The upper hinge assembly further includes a fastener configured to join the clamp to the elongated member by extending through the opening and being received in the guide sleeve.

DETAILED DESCRIPTION

Referring generally to the FIGURES, disclosed herein are shower door assemblies that include door bracket assemblies that are independently adjustable, including internal features and/or elements that define rotational positions and/or end points for the door (i.e., a self-closing or biasing door), and that can be coupled directly to a shower enclosure frame instead of a glass wall member. In this way, the shower door assemblies allow for selective adjustment of the shower door position relative to a door opening (e.g., to level, to correct for out-of-plumb conditions of the door, to adjust a horizontal position of the door, etc.), eliminate the need for separate, external stop mechanisms or latches to set the rotational end points for the door, and have greater structural stability and eliminate the need for additional hardware and/or components (e.g., additional brackets, gaskets, bolts, etc.).

Figure 1A:
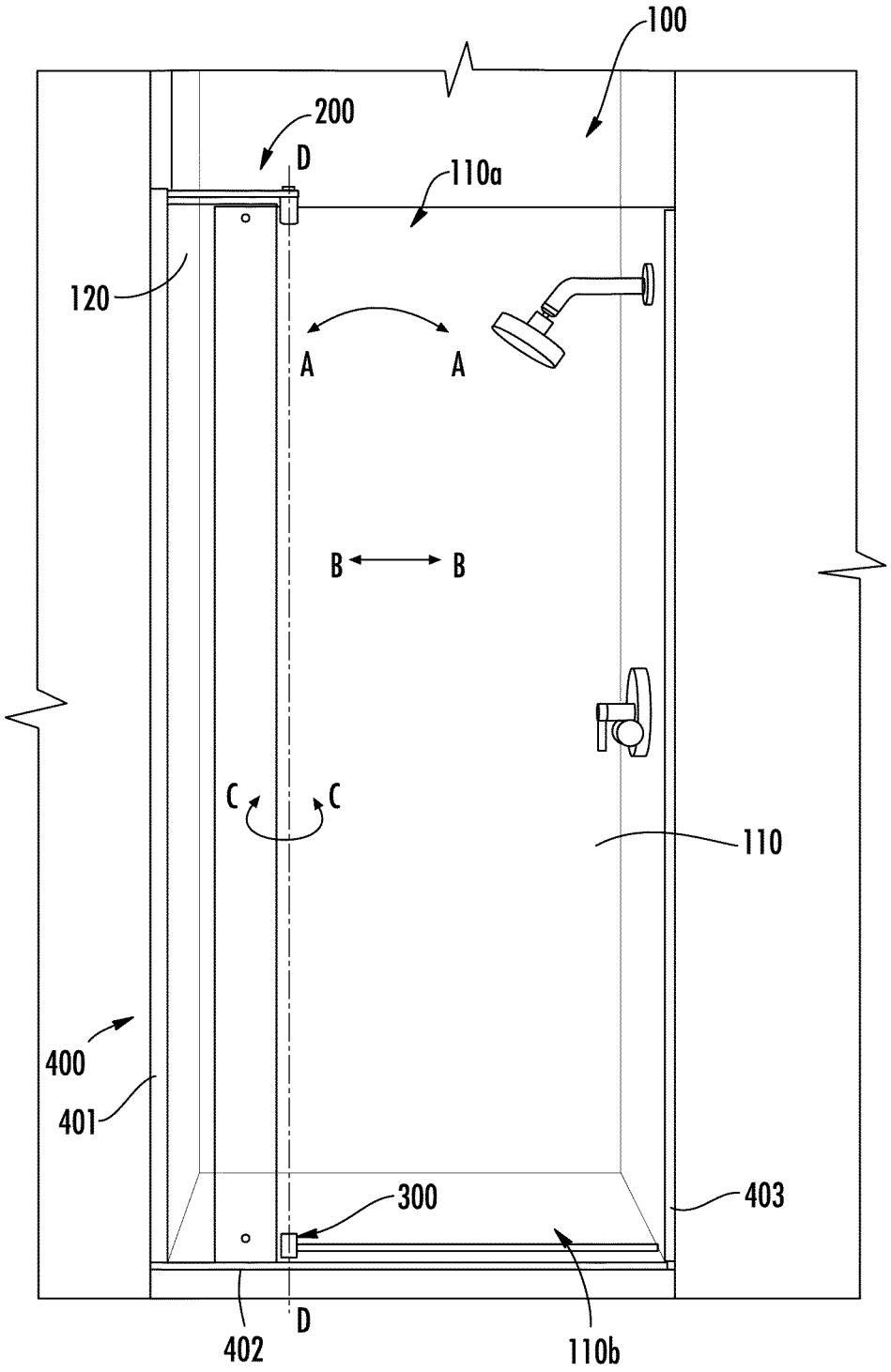
FIG. 1A is a front view of a shower door assembly according to an exemplary embodiment.
Figure 1B:
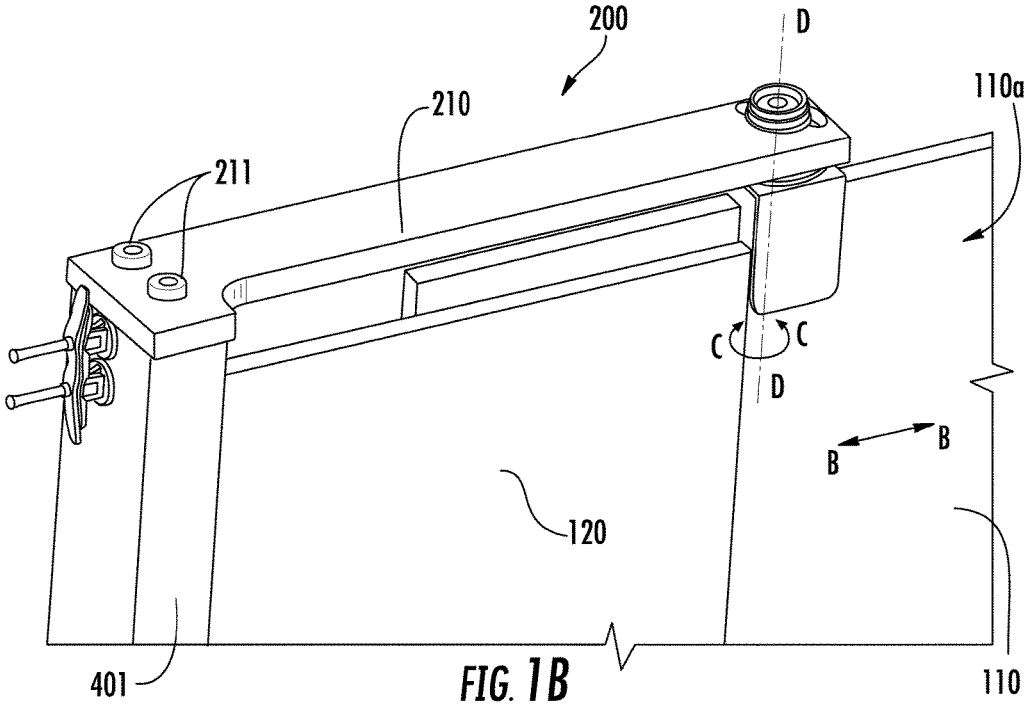
FIG. 1B is a partial perspective view of an upper portion of the shower door assembly of FIG. 1A.
Figure 1C:
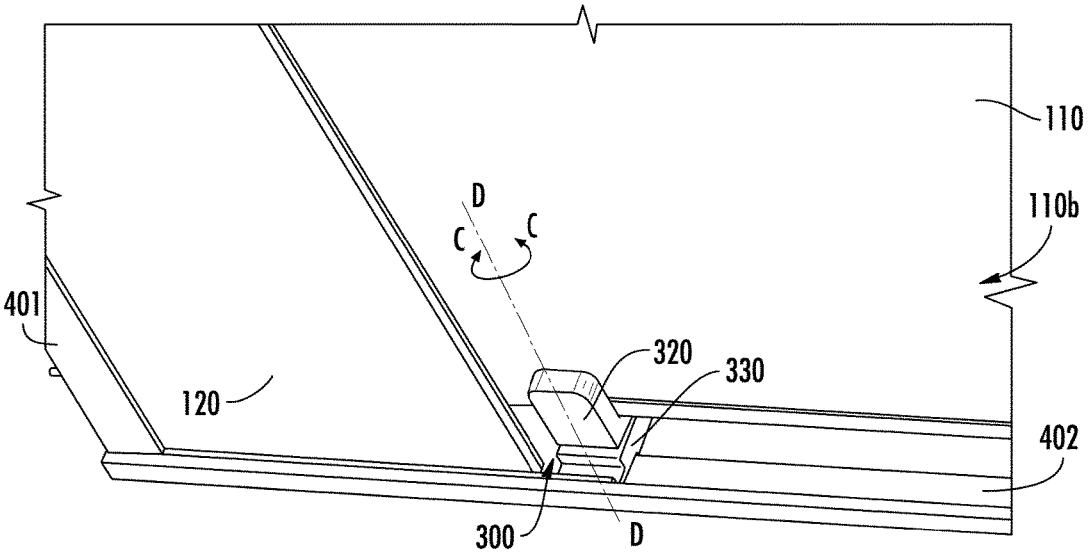
FIG. 1C is a partial perspective view of a lower portion of the shower door assembly of FIG. 1A.
Figure 1D:
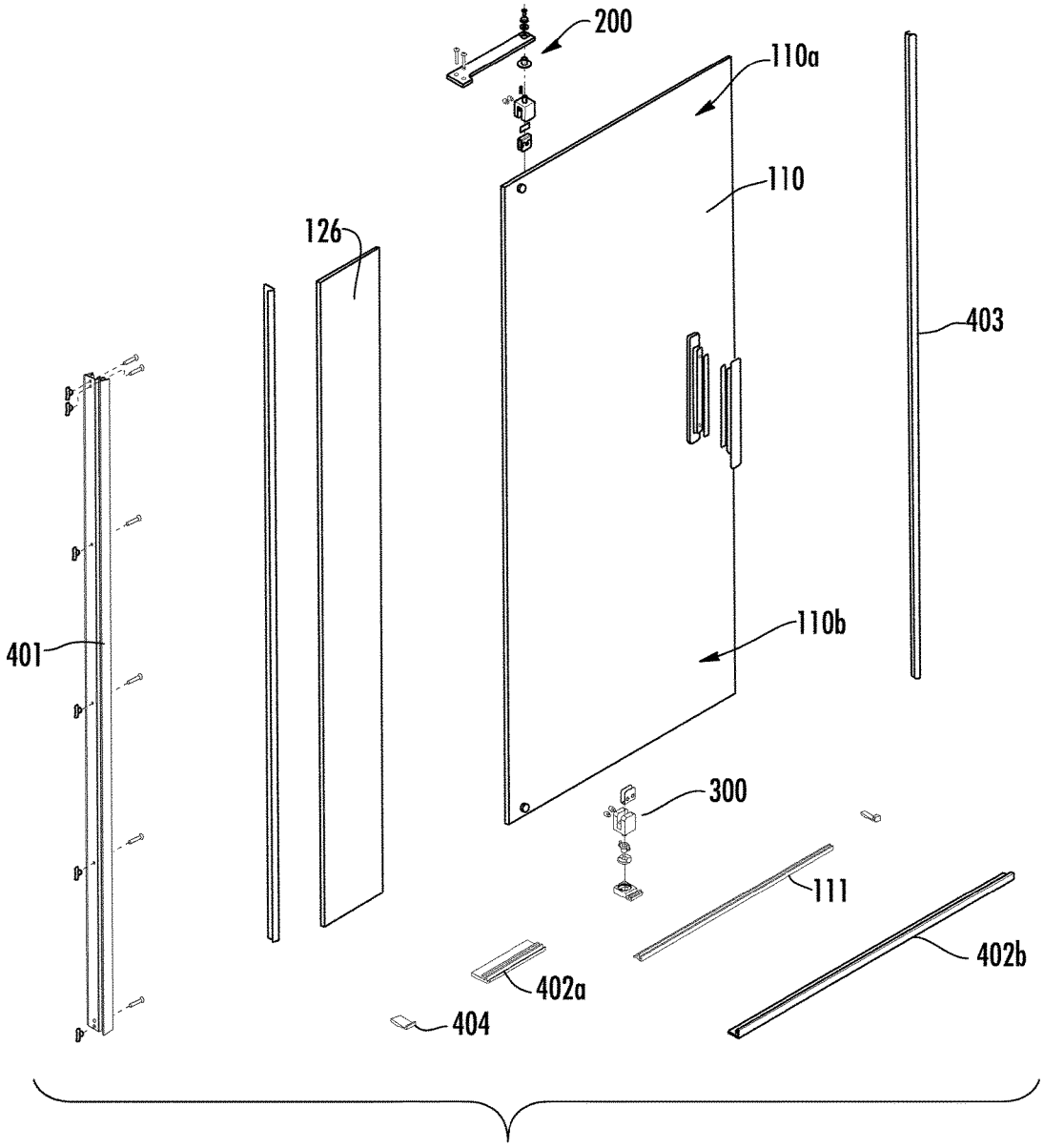
FIG. 1D is an exploded view of the shower door assembly of FIG. 1A.

Referring now to FIGS. 1A and 1D, a shower door assembly 100 includes a frame 400, according to an exemplary embodiment. The frame 400 includes a first side rail 401, a bottom rail 402, and a second side rail 403. Each of the first and second side rails 401 and 403 are coupled to a fixed structure, such as a wall of a shower enclosure, a wall of a building, a joist, a frame, or another type of fixed structure or fixed portion of the building. The bottom rail 402 is coupled between the first and second side rails 401 and 403 to a bottom portion of the fixed structure, such as a floor of a building, a base of a shower enclosure, or a receptor of a shower or bath. As shown in FIGS. 1A and 1B, the first side rail 401 is configured to couple a portion of a bracket assembly 200 to the fixed structure. The first side rail 401 is further configured to receive a fixed or stationary wall member 120 to couple the wall member 120 to the fixed structure (e.g., via one or more fasteners, such as bolts, adhesive, etc.). The wall member 120 may define at least a portion of a shower enclosure or bathing area. According to other exemplary embodiments (not shown), the frame 400 may include additional or fewer rails, frame elements, hardware, or the like. According to other exemplary embodiments, the shower door assembly 100 does not include a frame 400, but instead the respective component parts of the shower door assembly may be coupled directly to the fixed structure.

According to an exemplary embodiment, the wall member 120 is a glass panel that is substantially planar. According to other exemplary embodiments (not shown), the wall member 120 is partially made of glass and/or includes additional or different materials or sections, such as metal, plastic, wood, composite, or any other suitable material. According to other exemplary embodiments (not shown), the wall member 120 is substantially non-planar or includes substantially non-planar portions.

Referring to FIGS. 1A and 1D, the shower door assembly 100 further includes a door panel 110 pivotably coupled to the frame 400 via an upper bracket assembly 200 and a lower bracket assembly 300, according to an exemplary embodiment. The door panel 110 is positioned offset relative to the wall member 120, such that at least a portion of the door panel 110 is positioned behind the wall member 120 in a partially overlapping arrangement (as shown in FIGS. 1B and 1C). The door panel 110 is configured to pivot about a longitudinal axis D-D extending through the brackets 200 and 300. The door panel 110 is configured to pivot through a door opening defined by an edge of the wall member 120 and the second side rail 403, to thereby allow a user to enter and exit the shower enclosure. According to other exemplary embodiments, the door opening is defined by an edge of the wall member 120 and a fixed wall of a building, a shower enclosure wall, or another fixed structure or fixed portion of the building.

The door panel 110 is also configured to be selectively adjusted via the upper bracket assembly 200 and/or the lower bracket assembly 300 to level (i.e., correct for out-of-plumb conditions) of the door panel 110 (denoted by arrows A-A in FIG. 1A) and/or to adjust a horizontal position of the door panel 110 relative to the door opening of the shower or enclosure (denoted by arrows B-B in FIG. 1A). The door panel 110 is further configured to self-close or bias (i.e., set a rotational position) to, for example, a fully opened door position and/or a fully closed door position via the upper bracket assembly 200 and/or the lower bracket assembly 300, without the need for a separate, external mechanism or feature (e.g., latches, bumpers, magnets, striker plates, etc.).

According to an exemplary embodiment, the door panel 110 is a glass panel that is substantially planar. According to other exemplary embodiments (not shown), the door panel 110 is partially made of glass and/or includes additional or different materials or sections, such as metal, plastic, wood, composite, or any other suitable material. According to other exemplary embodiments (not shown), the door panel 110 is substantially non-planar or includes substantially non-planar portions.

Referring now to FIG. 1B, an upper portion of the shower door assembly 100 of FIG. 1A including the upper bracket assembly 200 is shown, according to an exemplary embodiment. As shown in FIG. 1B, the upper bracket assembly 200 includes an elongated member 210 coupled to a top end of the first side rail 401 of the frame 400, such that the elongated member 210 is fixed relative to the fixed structure. The elongated member 210 extends inward in a substantially horizontal direction toward an interior of the shower as a cantilever from the frame 400. The elongated member 210 is configured to pivotably couple an upper portion of the door panel 110*a* relative to the frame 400 and the fixed structure. According to other exemplary embodiments (not shown), the elongated member 210 is coupled directly to the fixed structure (e.g., a wall of a building, a shower enclosure wall, etc.). In this way, the shower door assembly 100 has sufficient structural support while avoiding connections to the glass wall member 120, thereby eliminating the need for additional hardware (e.g., gaskets, bolts, brackets, etc.) and providing greater design flexibility for the wall member 120 (e.g., different wall member materials, designs, shapes, surface contours, etc.). Moreover, the stress induced by the pivoting door panel is not applied to the fixed wall member 120, reducing concerns or the possibility that the fixed wall member 120 will be damaged over time.

As shown in FIG. 1B, the elongated member 210 is coupled to the top of the first side rail 401 at a proximal end via two fasteners shown as bolts 211, although the elongated member 210 may be coupled to the first side rail 401 in other manners (e.g., brackets, snap features, screws, etc.) and at other locations, according to other exemplary embodiments (not shown). The elongated member 210 is substantially planar and is L-shaped. The L-shaped configuration allows for the offset positioning of the door panel 110 relative to the wall member 120, such that a portion of the door panel 110 is positioned behind the wall member 120 in a partially overlapping position.

The elongated member 210 includes a distal end configured to receive a pivotable clamp assembly 220, shown disposed below the elongated member 210 according to an exemplary embodiment. At least a portion of the pivotable clamp assembly 220 is configured to pivot (denoted by arrows C-C in FIG. 1B) relative to the elongated member 210 about the longitudinal axis D-D. The pivotable clamp assembly 220 is configured to be selectively coupled to the upper portion of the door panel 110*a*, such that the door panel 110 pivots about the longitudinal axis D-D defined by the pivotable clamp assembly 220. In this way, the pivotable clamp assembly 220 thereby enables the ingress and egress of a user into/from the shower. The position of the door panel 110 relative to the pivotable clamp assembly 220 can be selectively adjusted to, for example, level or correct for an out-plumb condition of the door panel 110 relative to a door opening or to adjust a horizontal position (i.e., a door width) of the door panel 110 relative to the door opening (denoted by arrows B-B in FIG. 1B). A user or an installer may unclamp the pivotable clamp assembly 220 from the door panel 110 (e.g., by loosening bolts, etc.) and move the door panel to a desired position relative to the clamp assembly 220. The user or installer may then re-clamp (e.g., by tightening bolts, etc.) the door panel 110 within the clamp assembly 220 to reset the door panel position.

According to an exemplary embodiment, the elongated member 210 may be made out of a semi-rigid or a rigid material or combinations of materials, such as aluminum, steel, plastic, or any other material suitable for use in a bathing environment. According to an exemplary embodiment, the elongated member 210 includes a surface treatment, such as plating (e.g., chrome, nickel, etc.), paint, ceramic coating, or the like to protect the elongated member 210 and/or to provide an aesthetically pleasing appearance.

Referring now to FIG. 1C, a lower portion of the shower door assembly 100 of FIG. 1A including the lower bracket assembly 300 is shown according to an exemplary embodiment. As shown in FIG. 1C, the lower bracket assembly 300 includes a base 330 coupled to the bottom frame rail 402 of the frame 400. According to an exemplary embodiment, the base 330 is disposed on the floor (e.g., a base of a shower enclosure, a receptor, or another fixed portion of the bathing area), but is not fastened and/or coupled to any other component in the shower area. According to another exemplary embodiment, a user or an installer may apply a silicone bead around a periphery of the base 330 once the shower door is installed. The base 330 is configured to receive a pivotable clamp assembly 320 at an upper portion thereof. According to an exemplary embodiment, the pivotable clamp assembly 320 is similar to the pivotable clamp assembly 220 described above with respect to FIG. 1B. The pivotable clamp assembly 320 is configured to pivotably couple a lower portion of the door panel 110*b* to the fixed structure, such that the door panel 110 can selectively pivot about a longitudinal pivot axis D-D, to thereby enable the ingress and egress of a user from the shower.

According to an exemplary embodiment, the position of the door panel 110 relative to the pivotable clamp assembly 320 may be selectively and independently adjusted (i.e., independently from the upper bracket assembly 200) to, for example, level or correct for an out-of-plumb condition of the door panel 110 relative to a door opening of the shower (denoted by arrows A-A). Furthermore, the door panel 110 may be selectively moved (e.g., slid, translated, etc.) relative to both the upper bracket assembly 200 and the lower bracket assembly 300 to adjust a horizontal position of the door panel 110 relative to a door opening of the shower (denoted by arrows B-B).

Figure 2A:
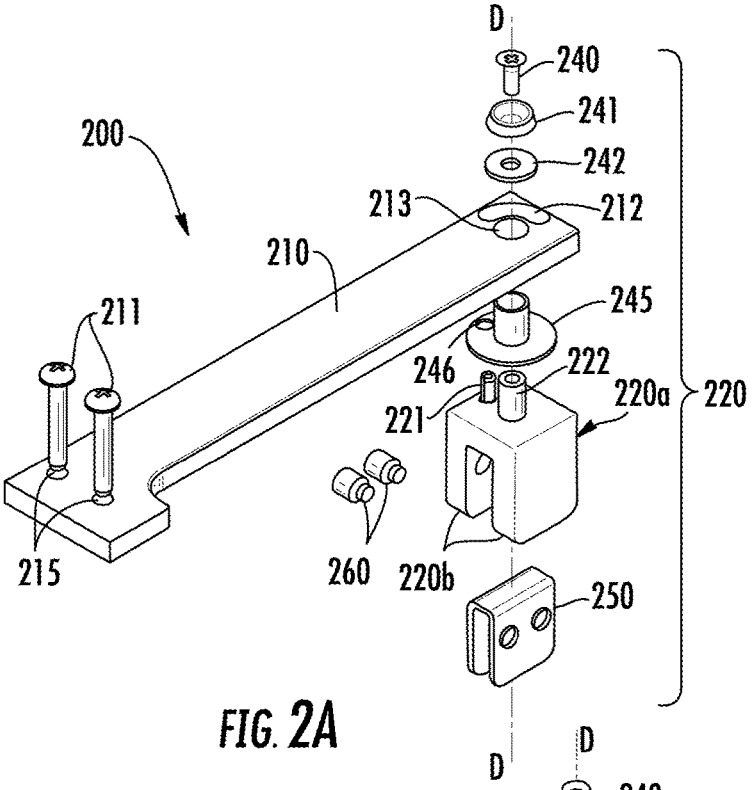
FIG. 2A is an exploded view of an upper portion of the shower door assembly of FIG. 1A including an upper bracket assembly.
Figure 2B:
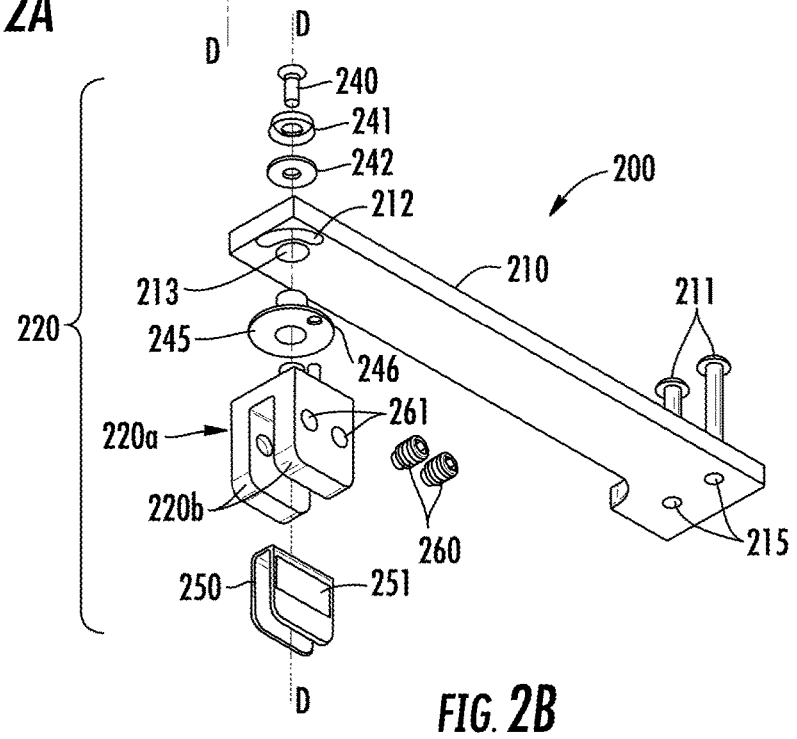
FIG. 2B is another exploded view of the shower door assembly of FIG. 2A.

Referring now to FIGS. 2A and 2B, exploded views of an upper portion of the shower door assembly 100 are shown according to an exemplary embodiment. As shown in FIGS. 2A and 2B, the upper bracket assembly 200 includes a pivotable clamp assembly 220 pivotably coupled to the elongated member 210. The elongated member 210 includes a pair of through holes 215 configured to receive two bolts 211 to couple the elongated member 210 to the first side rail 401 of the frame 400. The elongated member 210 further includes a circumferential slot 212 disposed near a distal end of the elongated member 210. The circumferential slot 212 extends about a circumference sufficient to limit the rotational travel of the door panel 110. That is to say, the circumferential slot 212 is configured to establish, in part, the rotational end points for the door panel 110. The elongated member 210 also includes an opening 213 disposed adjacent to the circumferential slot 212. The opening 213 is configured to receive a bushing 245 to enable relative rotational movement of the pivotable clamp assembly 220.

Still referring to FIGS. 2A and 2B, the pivot clamp assembly 220 is configured to pivotably couple the upper portion of the door panel 110*a* to the elongated member 210, according to an exemplary embodiment. The pivot clamp assembly 220 includes a clamp 220*a* and a sleeve 250 coupled between opposing flanges 220*b* of the clamp 220*a*. The sleeve 250 is configured to receive the upper portion of the door panel 110*a* therein, and to protect the door panel 110 from being damaged (e.g., cracked, chipped, etc.) when the door panel 110 is coupled (e.g., clamped) within the clamp 220*a*. For example, the upper portion of the door panel 110*a* may be inserted into the sleeve 250 between opposing flanges 220*b* of the clamp 220*a*. Two or more bolts 260 threadably engage respective through holes 261 disposed in one side (i.e., one flange) of the clamp 220*a*. The bolts 260 can be threaded into the respective through holes until a portion of the bolts 260 sufficiently engages the sleeve 250, such that the upper portion of the door panel 110*a* is sandwiched (i.e., clamped, secured, etc.) between the opposing flanges 220*b* of the clamp 220*a* within the sleeve 250. According to the exemplary embodiment shown in FIG. 2B, the sleeve 250 includes an insert 251 configured to engage/receive a portion of the bolts 260. The insert 251 is sufficiently rigid to prevent or impede deformation when the bolts 260 are threadably engaged with the clamp 220*a* to couple the door panel 110 thereto.

According to an exemplary embodiment, a user or installer may selectively move or adjust a position of the door panel 110 within the clamp 220*a* by loosening the bolts 260 from the clamp 220*a*. The user or the installer may then move (e.g., slide, translate, etc.) the door panel 110 relative to the sleeve 250 and the clamp 220*a* to a desired position (denoted by arrows A-A and B-B in FIGS. 1A and 1B). Once the door panel 110 is at a desired position, the user or the installer may tighten the bolts 260 against the sleeve 250 within the clamp 220*a* to re-set the position of the door panel 110. In this manner, the upper bracket assembly 200 allows for the selective and independent adjustment of the position of the door panel 110 relative to the upper bracket assembly 200. The same adjustment can be performed on the lower bracket assembly 300, which is described in greater detail below.

According to an exemplary embodiment, the sleeve 250 is made from a soft, flexible material sufficient to protect a glass door panel from being damaged (e.g., scratched, cracked, etc.) when the door panel is coupled to the clamp 220*a*. According to an exemplary embodiment, the sleeve 250 is made from a polymer, such as nylon, polypropylene, or another material suitable for the particular application of the sleeve 250. According to an exemplary embodiment, the sleeve 250 is coupled to the clamp 220*a* via snap-fit features (e.g., bosses, snaps, etc.), press-fit features, or a similar fastening arrangement. According to other exemplary embodiments, the sleeve 250 is coupled to the clamp 220*a* using another type of fastener or combination of fasteners, such as screws, bolts, adhesive, or the like.

Still referring to FIGS. 2A and 2B, the clamp 220*a* further includes a pin 221 and a threaded guide sleeve 222, each extending upward in a longitudinal direction from an upper surface of the clamp 220*a*. The pin 221 is configured to be inserted into the circumferential slot 212 and to selectively move within the slot 212 during rotation of the door panel 110. The pin 221 is further configured to establish end points for rotation of the door panel 110 by selectively engaging and disengaging the ends of the circumferential slot 212 (i.e., where the slot terminates along its circumference). That is to say, the clamp 220*a* is configured to pivot relative to the elongated member 210 and the pin 221 establishes the end points for rotation of the clamp 220*a* to limit rotational travel of the door panel 110. The threaded guide sleeve 222 is configured to locate the clamp 220*a* relative to the elongated member 210 by being inserted into the longitudinal opening 213. The threaded guide sleeve 222 is further configured to receive a fastener shown as a threaded bolt 240 to fix a longitudinal position of the clamp 220*a* relative to the elongated member 210.

Figure 2C:
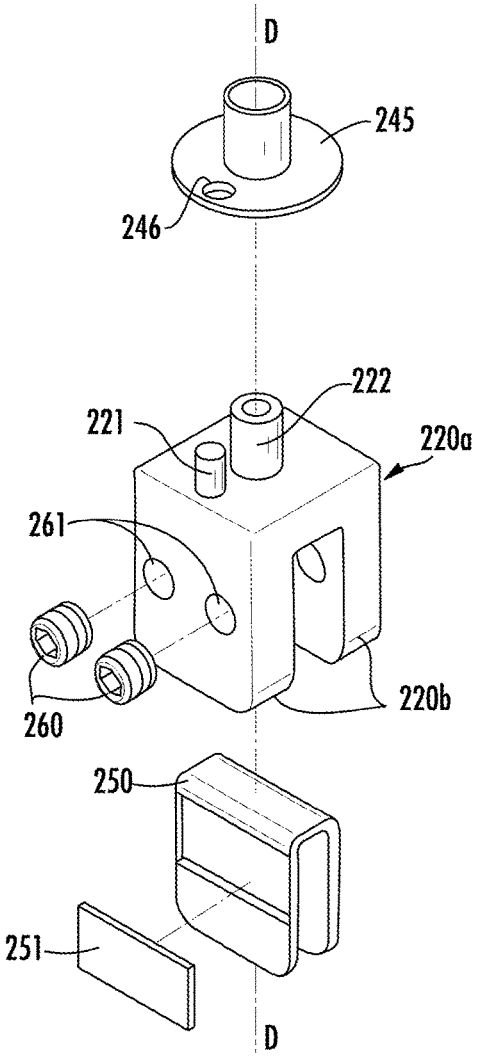
FIG. 2C is an exploded view of a portion of the upper bracket assembly of FIGS. 2A and 2B.
Figure 2D:
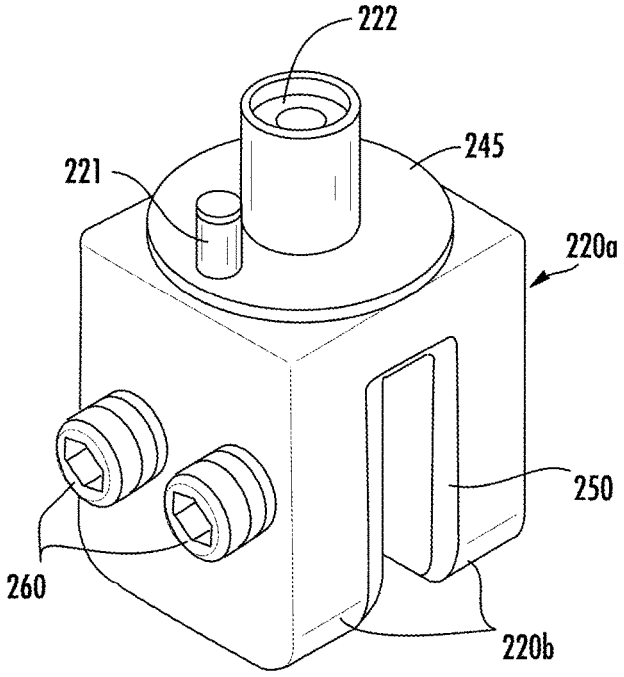
FIG. 2D is a perspective view of a portion of the upper bracket assembly of FIGS. 2A and 2B.

According to an exemplary embodiment, a bushing 245 is disposed between the clamp 220*a* and the elongated member 210 to facilitate rotational movement of the clamp 220*a* relative to the elongated member 210. As shown in FIGS. 2C and 2D, the bushing 245 substantially surrounds the threaded guide sleeve 222 and is configured to reduce wear of the guide sleeve and/or the opening 213. The bushing 245 includes an opening 246 at an outer periphery of the bushing 245 for inserting the pin 221 therethrough. The bolt 240 pivotably couples the clamp 220*a* to the elongated member 210 by threadably engaging the threaded guide sleeve 222. As shown in FIGS. 2A and 2B, a flat washer 242 and a counter-sunk washer 241 are disposed between the bolt 240 and the guide sleeve 222 to permit relative rotational movement of the clamp 220*a*, but to fix the longitudinal position and/or orientation of the clamp 220*a* relative to the elongated member 210. According to other exemplary embodiments (not shown), the assembly includes additional or fewer hardware components, such as washers, bolts, gaskets, bushings, and the like.

Figure 3A:
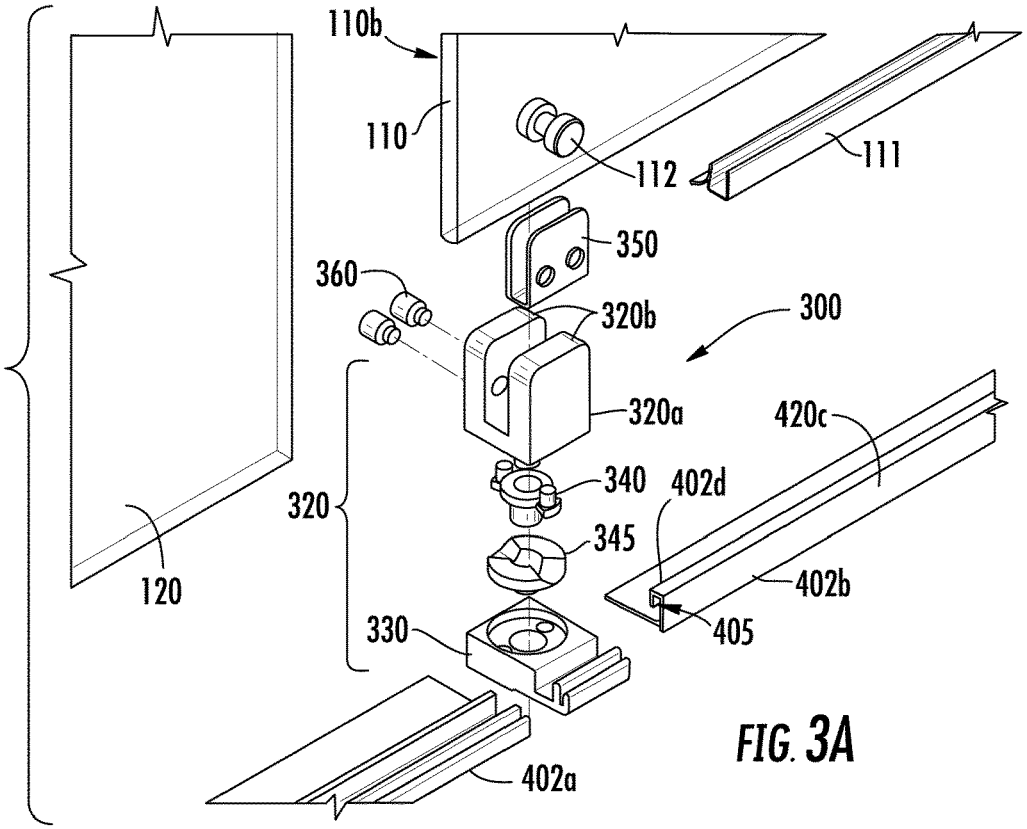
FIG. 3A is a partial exploded view of a lower portion of the shower door assembly of FIG. 1A including a lower bracket assembly.
Figure 3B:
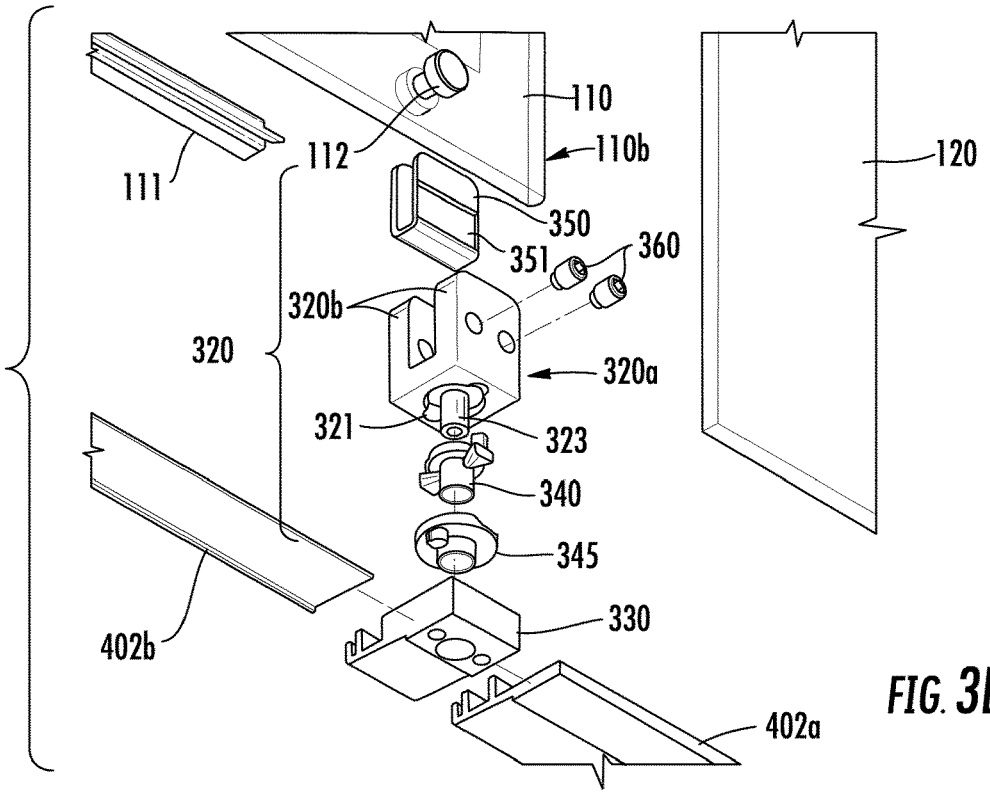
FIG. 3B is another partial exploded view of the shower door assembly of FIG. 3A.

Referring now to FIGS. 3A and 3B, exploded views of a lower portion of the shower door assembly 100 are shown according to an exemplary embodiment. As shown in FIGS. 3A and 3B, the lower bracket assembly 300 includes a pivotable clamp assembly 320 pivotably coupled to a base 330 through a cam 340 and a receiver 345. The pivotable clamp assembly 320 includes a clamp 320*a* and a sleeve 350 coupled between opposing flanges of the clamp 320*a*. The sleeve 350 is configured to receive the lower portion of the door panel 110*b* therein, and to protect the door panel 110 from being damaged (e.g., cracked, chipped, etc.) when the door panel is coupled (e.g., clamped) within the clamp 320*a*. For example, the lower portion of the door panel 110*b* may be inserted into the sleeve 350 between opposing flanges 320*b* of the clamp 320*a*. Two or more bolts 360 can threadably engage threaded through holes 361 disposed in one side (i.e., one flange 320*b*) of the clamp 320*a*. The bolts 360 may be threaded into the respective through holes 361 until they sufficiently engage the sleeve 350, such that the lower portion of the door panel 110*b* is sandwiched (i.e., clamped, secured, etc.) between the opposing flanges 320*b* of the clamp 320*a* within the sleeve 350. According to the exemplary embodiment shown in FIG. 3B, the sleeve 350 includes an insert 351 configured to engage and/or receive a portion of the bolts 360. The insert 351 is sufficiently rigid to prevent or impede deformation when the bolts 360 threadably engage the clamp 320*a* to couple (e.g., clamp) the door panel 110.

According to an exemplary embodiment, a user or installer may selectively move or adjust a position of the door panel 110 within the clamp 320*a* by loosening the bolts 360 from the clamp 320*a*. The user or the installer may then move the door panel 110 relative to the sleeve 350 and the clamp 320*a* to a desired position. Once the door panel 110 is at the desired position, the user or installer may tighten the bolts 360 against the sleeve 350 within the clamp 320*a* to set the position of the door panel 110. In this manner, the lower bracket assembly 300 allows for the selective and independent adjustment of the position of the door panel 110 relative to the lower bracket assembly 300. According to an exemplary embodiment, the user or installer may adjust a position of the door panel 110 relative to both the upper bracket assembly 200 and the lower bracket assembly 300, either simultaneously or independently.

According to an exemplary embodiment, the sleeve 350 is made from a soft, flexible material sufficient to, for example, protect a glass door panel from being damaged (e.g., scratched, cracked, etc.) when the door panel is coupled to the clamp 320*a*. According to an exemplary embodiment, the sleeve 350 is made from a polymer, such as nylon, polypropylene, or another material suitable for the particular application of the sleeve 350. According to an exemplary embodiment, the sleeve 350 is coupled to the clamp 320*a* via snap-fit features (e.g., bosses, snaps, etc.), press-fit features, or a similar fastening arrangement. According to other exemplary embodiments, the sleeve 350 is coupled to the clamp 320*a* using another type of fastener or combination of fasteners, such as screws, bolts, adhesive, or the like.

Still referring to FIGS. 3A and 3B, the door panel 110 includes a bumper 112 coupled to a front surface of the door panel according to an exemplary embodiment. According to an exemplary embodiment, the door panel 110 includes one or more bumpers 112 positioned at the upper and/or lower portions of the door panel 110*a* and 110*b*. The bumper 112 is configured to protect the door panel 110 from contacting the wall member 120 if, for example, the door panel 110 is rotated (i.e., pivoted) beyond an extreme end point of rotation. That is, if the door panel 110 is rotated beyond a rotational end point, the bumper 112 will contact a rear surface of the wall member 120 where the door panel 110 overlaps with the wall member 120, thereby protecting the door panel 110 and the wall member 120 from directly contacting each other.

According to an exemplary embodiment, the door panel 110 includes a seal 111 coupled (e.g., glued, bonded, press-fit, etc.) to a bottom edge of the door panel 110. The seal 111 is configured to prevent water or other fluids (e.g., liquid soap, shampoo, etc.) from leaking from the interior of the shower between the door panel 110 and the bottom rail 402 of the frame 400. The seal 111 includes a portion (e.g., a flap, etc.) configured to cover a gap between a bottom edge of the door panel 110 and the bottom rail 402, to thereby prevent water or other fluids from leaking through the gap.

As shown in FIGS. 3A and 3B, the bottom rail 402 includes two sections 402*a* and 402*b*. According to an exemplary embodiment, the base 330 and the first rail section 402*a* are configured to slide into a channel 405 defined by the second rail section 402*b*. A wall jamb seat 404 is configured to slide into and couple to the second rail section 402*b*. The wall jamb seat 404 is further configured to receive a bottom end of the first side rail 401. The first rail section 402*a* includes a plurality of flanges defining a channel therein. The channel is configured to receive a bottom edge of the wall member 120 to couple a portion of the wall member 120 to the fixed structure. Similarly, the base 330 includes one or more flanges defining a channel that is substantially the same as the channel defined by the flanges of the first rail section 402*a*. In this way, a portion of the base 330 forms a continuous channel with the first rail section 402*a*. Thus, according to an exemplary embodiment, a bottom edge of the wall member 120 may be received within the channel defined by the base 330 to couple the wall member 120 to the fixed structure. According to an exemplary embodiment, the second rail section 402*b* includes a flange 402*c* projecting upward therefrom and extending a length of the second rail section 402*b*. A lip 402*d* projects toward an interior of the shower from an upper end of the flange 402*c* to define the channel 405 between the flange 402*c* and the lip 402*d*. The second rail section 402*b* is configured to receive a second flange from each of the first rail section 402*a* and the base 330 within the channel 405. According to an exemplary embodiment, the first rail section 402*a* and the base 330 are slid into an end of the channel 405.

Still referring to FIGS. 3A, 3B, 3E, and 3F, the pivotable clamp assembly 320 includes a cam 340 coupled to a bottom portion of the clamp 320*a*. The pivotable clamp assembly 320 further includes a receiver 345 coupled to an upper portion of the base 330. The cam 340 is fixed relative to the clamp 320*a* and the receiver 345 is fixed relative to the base 330. The cam 340 is configured to be received within the receiver 345 and to rotate/pivot relative to the receiver 345. In this way, the clamp 320*a* may selectively rotate (i.e., pivot) relative to the base 330. Furthermore, the cam 340 and the receiver 345 include complementary features that define the endpoints for rotation of the door panel 110, such that the door panel 110 can self-lock without the need for a separate, external lock feature and/or mechanism.

Figure 3C:
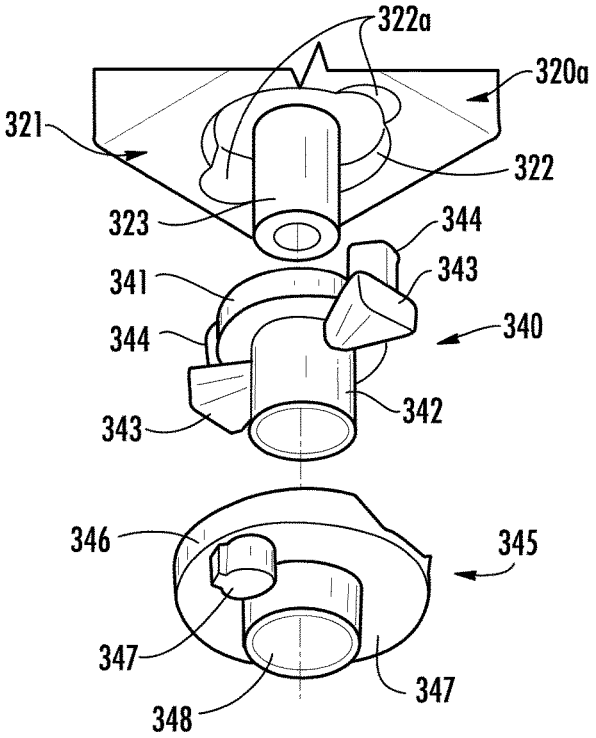
FIG. 3C is a partial exploded view of the lower bracket assembly of FIGS. 3A and 3B.
Figure 3D:
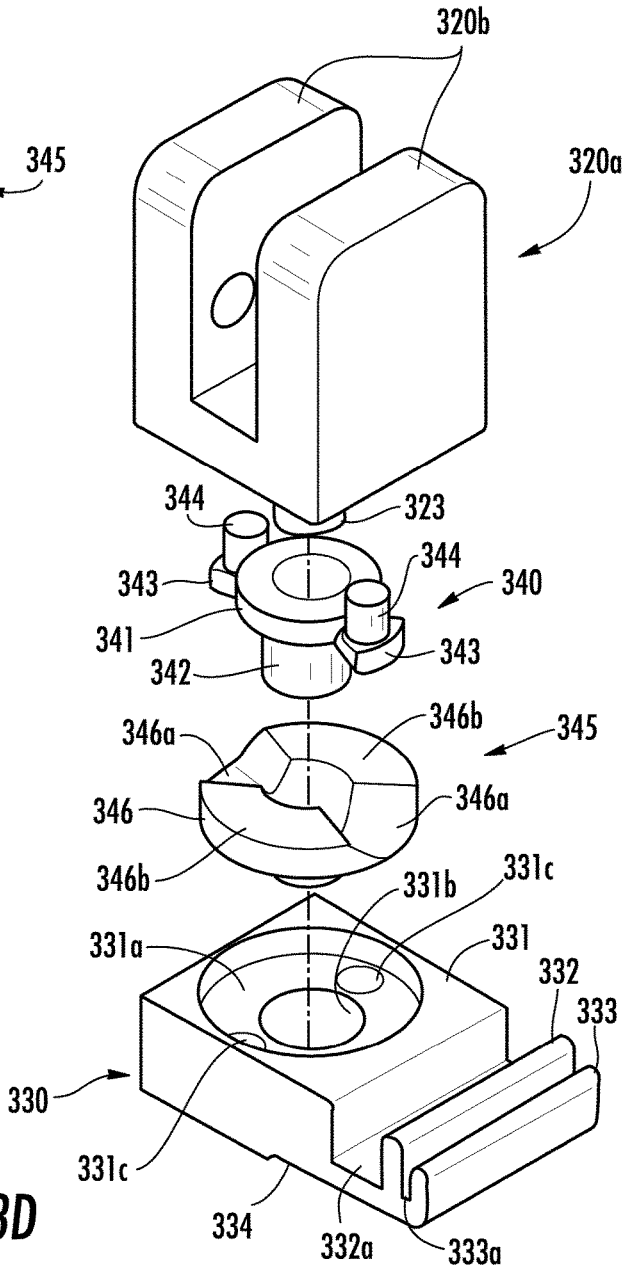
FIG. 3D is an exploded view of the lower bracket assembly of FIGS. 3A-3C.
Figure 3E:
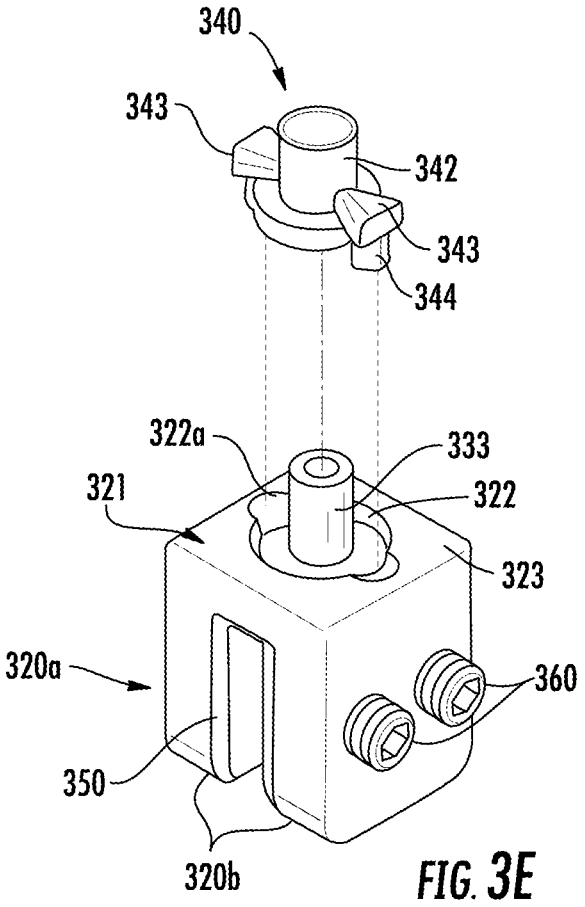
FIG. 3E is an exploded view of a portion of the lower bracket assembly of FIGS. 3A-3D.
Figure 3F:
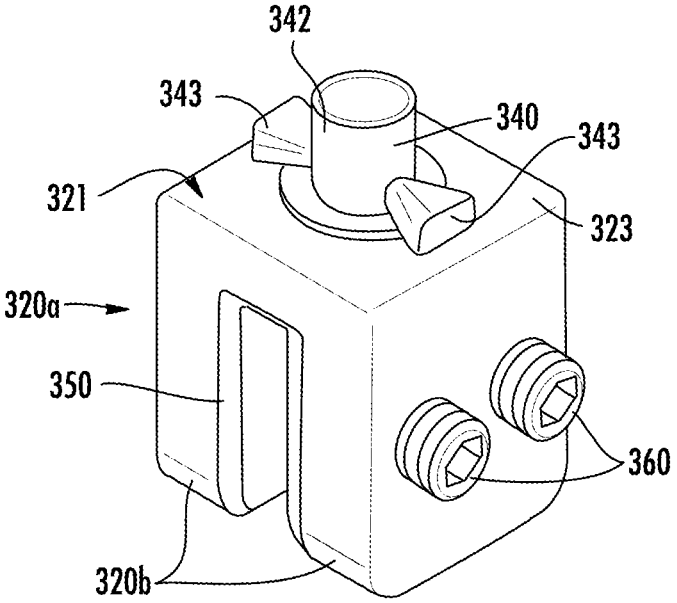
FIG. 3F is a perspective view of the portion of the lower bracket assembly of FIG. 3E.

Referring now to FIGS. 3C-3E, the clamp 320*a* includes a bottom surface 321. The bottom surface 321 defines a recess 322, the recess 322 having a generally cylindrical shape. The recess 322 further defines a plurality of smaller openings 322*a* at an outer periphery thereof. The clamp 320*a* further includes a peg 323 extending away from the bottom surface 321. The peg 323 has a substantially cylindrical shape and is centrally located on the base 321. The peg 323 may provide structural support to at least a portion of the cam 340.

According to an exemplary embodiment, the cam 340 is configured to mate with and engage the receiver 345 and to rotate (i.e., pivot) relative to the receiver 345. As shown in FIGS. 3C and 3D, the cam 340 includes a cylindrical base 341 and a cylindrical sleeve 342 extending downward therefrom. The base 341 and the sleeve 342 are configured to receive the peg 323 of the clamp 320. A pair of diametrically opposed wings 343 extend from an outer wall of the sleeve 342 near a bottom portion of the base 341. Each of the wings 343 includes a post 344 extending upward in a vertical direction. The base 341 and the posts 344 are configured to be inserted into the openings 322*a* of the recess 322 of the clamp 320*a*, such that the cam 340 is retained within and coupled to the clamp 320*a*. That is, the recess 322 includes an inner profile that is complementary to an outer profile of the cam 340. According to an exemplary embodiment, the cam 340 is press-fit into the recess 322.

Still referring to FIGS. 3C and 3D, the wings 343 have a contoured (e.g., curved, filleted, etc.) lower surface configured to provide sufficient frictional engagement with the receiver 345 to thereby create a tactile interaction for a user when the door panel 110 is selectively rotated (i.e., pivoted) by the user. Furthermore, the lower surfaces of the pair of the wings 343 are configured to selectively engage corresponding detents 346*a* (shown in FIG. 3D) on the receiver 345 to establish the end points for rotation of the door panel 110, facilitating self-locking (i.e., holding a pre-set position) or biasing of the door panel 110 at, for example, a fully opened or a fully closed door position. According to an exemplary embodiment, the cam 340 is made from a rigid or a semi-rigid material, such as a plastic (e.g., nylon, polypropylene, etc.) suitable for frictional engagement with the receiver 345, to thereby provide an acceptable rotational or tactile feel for the door panel 110 when the door panel 110 is selectively pivoted. According to an exemplary embodiment, the cam 340 is made from a material that is self-lubricating or includes a lubricant (e.g., grease, oil, etc.) to provide a desired rotational or tactile feel for the door panel 110. According to other exemplary embodiments (not shown), the receiver 345 includes additional detents 346*a* to provide additional set points for selectively locking or setting a rotational position of the door panel 110.

Referring to FIG. 3D, the base 330 includes a block 331 having a recess 331*a*. The block 331 includes a longitudinal opening 331*b* defined by a cylindrical inner wall extending through at least a portion of the block 331. One or more through holes 331*c* are disposed adjacent to the longitudinal opening. The through holes 331*c* are configured to allow the door to be used in either a left-handed or a right-handed opening situation. The through holes 331*c* are configured to receive the diametrically opposed posts 347 of the receiver 345. The receiver 345 is configured to couple to the base 330 such that the base 346, the post 347, and the cylindrical sleeve 348 are disposed within the block 331. In this way, the receiver 345 is fixed relative to the base 330.

As shown in FIGS. 3C and 3D, the receiver 345 includes a cylindrical base 346 and a cylindrical sleeve 348 extending downward therefrom. A pair of diametrically opposed posts 347 extend downward from a bottom surface of the base 346. The base 346 is configured to be received in a recess 331*a* of the base 330, such that the receiver 345 is retained within and coupled to the base 330. According to an exemplary embodiment, the sleeve 347 of the receiver 345 is received in the longitudinal opening 331*b* of the block 331. Furthermore, the posts 347 are received in through holes 331*c* of the block 331. In this way, the receiver 345 is fixed relative to the base 330. An upper portion of the base 346 includes a planar surface 346*b* defining a plurality of diametrically opposed detents 346*a* (e.g., depressions, recesses, etc.). The pair of detents 346*a* have a surface profile that is complementary to the bottom surface profile of the diametrically opposed wings 343 of the cam 340, such that the wings 343 may be received within (i.e., seated in) the respective detents 346*a*. The detents 346*a* gradually transition to the planar surfaces 346*b* located above the detents 346*a*. In this way, when the diametrically opposed wings 343 are engaged with (i.e., seated in) the respective detents 346*a* and the cam 340 is rotated (i.e., pivoted), the wings 343 transition smoothly out of engagement with the detents 346*a* to then engage the planar surfaces 346*b*. This configuration causes the door panel 110 to lift slightly (e.g., ⅛ inch, etc.) in a vertical direction. Thus, when the door panel 110 is rotated back to an extreme end point position (e.g., a fully closed position), the door panel 110 will drop down slightly (e.g., ⅛ inch, etc.), because the wings 343 will engage the detents 346*a* located below the planar surfaces 346*b*.

This configuration allows the door panel 110 to drop down a sufficient distance to engage the floor or base of the shower or bathing enclosure, such that water or other fluids do not seep out of the shower or bathing enclosure when the door panel 110 is in a fully closed position. Furthermore, this configuration provides additional rotational resistance (between the cam 340 and the receiver 345) while the door is moving (e.g., rotating, pivoting, etc.) and gives a tactile feel to a user when the door panel 110 drops down at the rotational end point positions.

According to an exemplary embodiment, the detents 346*a* are disposed below the planar surfaces 346*b* a distance sufficient to indicate to a user that the door panel 110 has reached a rotational end point and to set the door panel 110 at that position. That is to say, the transition between the planar surfaces 346*b* and the detents 346*a* is such that when the door panel 110 is rotated to a rotational end point (e.g., a fully opened or a fully closed door position), the door panel 110 will self-close or bias via the selective engagement of the cam 340 (e.g., the diametrically opposed wings 343) with the respective detents 346*a*. In this manner, the door panel 110 may self-close or bias at a rotational end point position without the need for a separate lock or latch mechanism or element. Furthermore, the self-closing or biasing feature requires minimal effort (e.g., force, etc.) from a user to ensure that the diametrically opposed wings 343 properly engage the respective detents 346*a*.

As shown in FIG. 3D, the base 330 includes first and second flanges 332 and 333 extending outward from the block 331. The first and second flanges 332 and 333 define first and second channels 332*a* and 333*a* of the base 330, respectively. The first channel 332*a* is configured to receive a portion of the wall member 120. The second flange 333 engages the bottom rail 402. According to an exemplary embodiment, the second flange 333 slides into the channel defined by the second rail section 402*b*. The base 330 also includes an undercut portion 334 extending along a bottom of the base 330 from the block 331 to the flanges 332 and 333. An undercut portion 334 is configured to enable proper mounting of the base 330 relative to a fixed structure. That is, the undercut portion 334 may receive, for example, a portion of a door frame of a shower enclosure, a seal, or another element, to allow the base 330 to be oriented properly for pivotably coupling the door panel 110.

Figure 4:
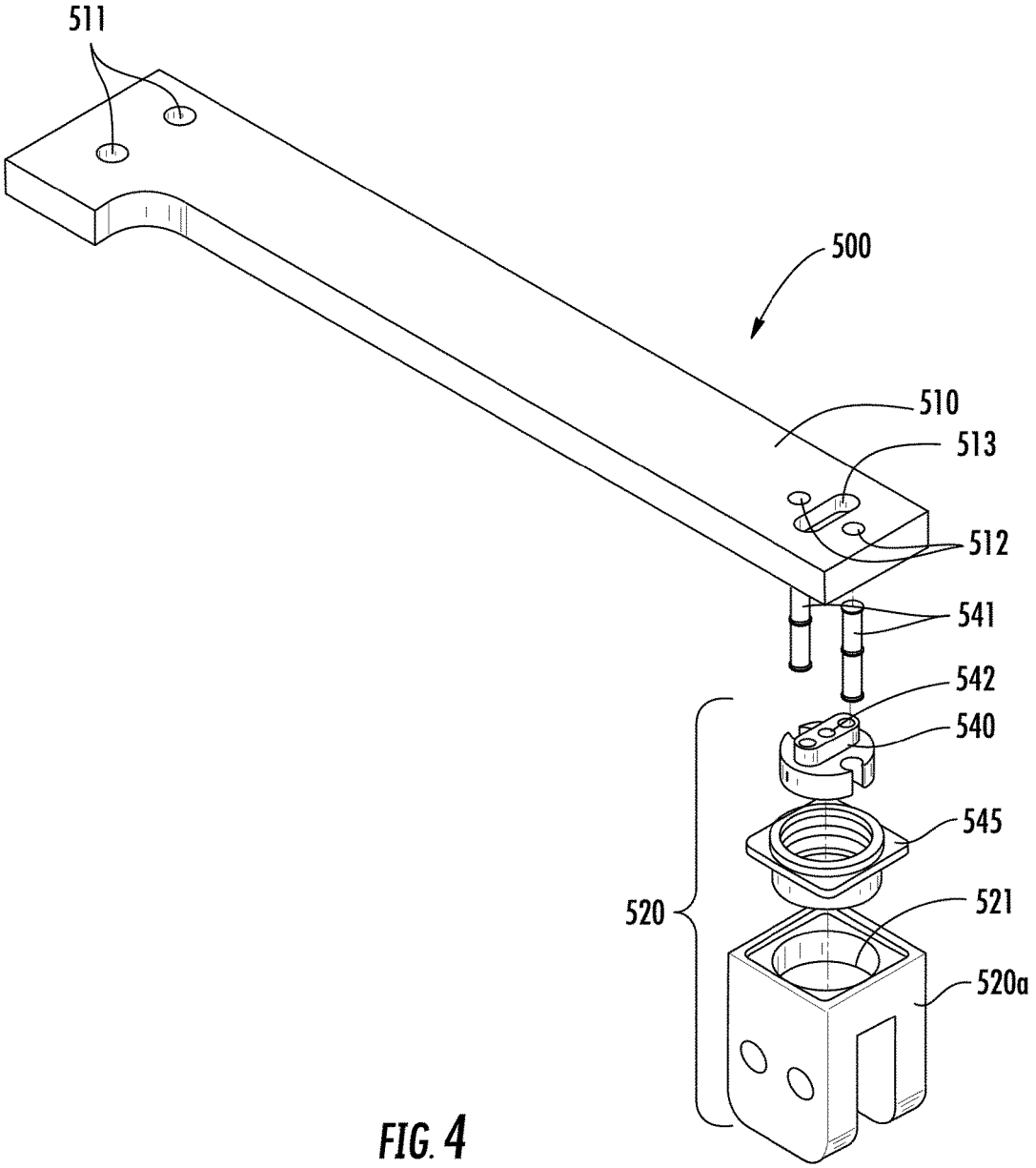
FIG. 4 is a perspective view of a pivotable clamp assembly for an upper bracket assembly, according to another exemplary embodiment.

Referring now to FIG. 4, a pivotable clamp assembly 520 for an upper door bracket assembly 500 is shown according to another exemplary embodiment. FIG. 4 shows the pivotable clamp assembly 520 for use in the upper portion of the door panel 110*a*, but the pivotable clamp assembly 520 may be configured for the lower portion of the door panel 110*b*. In the embodiment shown in FIG. 4, the door bracket assembly 500 includes an elongated member 510 that is similar to the elongated member 210 of FIGS. 1B, 2A, and 2B, but includes a slot 513 and a pair of through holes 512 positioned adjacent the slot 513 at a distal end of the elongated member 510. The elongated member 510 is coupled to the top of the first side rail 401 at a proximal end via two fasteners extending through holes 511, although the elongated member 210 may be coupled to the first side rail 401 in other manners (e.g., brackets, snap features, screws, etc.) and at other locations, according to other exemplary embodiments (not shown). The slot 513 is configured to receive a projection 542 of a cylindrical spacer 540, the projection 542 having a shape complementary to that of the slot 513. The projection 542 of the spacer 540 is configured to be inserted into the slot 513 and to couple a plurality of pins 541 to the elongated member 510 within respective through holes 512, such that a portion of each of the plurality of pins 541 extends (i.e., projects) downward away from the spacer 540. As shown, the pins 541 are substantially cylindrical in shape and are oriented in a substantially longitudinal direction.

According to an exemplary embodiment, the spacer 540 is press-fit into the slot 513, so as to rotationally fix the spacer 540 relative to the elongated member 510. According to other exemplary embodiments, the spacer 540 is coupled to the elongated member 510 in other ways, such as adhesive, fasteners, screws, or the like. According to an exemplary embodiment, the spacer 540 and the pins 541 may be made from any rigid or semi-rigid material or combinations of materials, such as aluminum, steel, plastic, or any other material suitable for the particular application within the pivotable clamp assembly 520.

Still referring to FIG. 4, the clamp assembly 520 includes a clamp 520*a* that is similar to the clamp 220*a* of FIGS. 1B and 2A and 2B, but includes a recessed portion 521 configured to receive at least a portion of a female member 545. The clamp 520*a* is also configured to receive, for example, the upper portion of the door panel 110*a*, to pivotably couple the upper portion of the door panel 110*a* to the elongated member 510.

As shown in FIG. 4, the female member 545 is configured to be inserted into the recessed portion 521, such that the female member is fixed relative to the clamp 520*a*. The female member 545 includes a pair of diametrically opposed circumferential slots (shown in FIG. 6) that are configured to receive a portion of each of the pins 541 therein. The female member 545 is configured to pivot relative to the pins 541 and to establish end points for rotation of, for example, a door panel 110. The size of the circumferential slots of the female member 545 (shown in FIG. 6) are sufficient to provide torsional resistance during rotation (i.e., pivoting) of, for example, a door panel 110.

Figure 5:
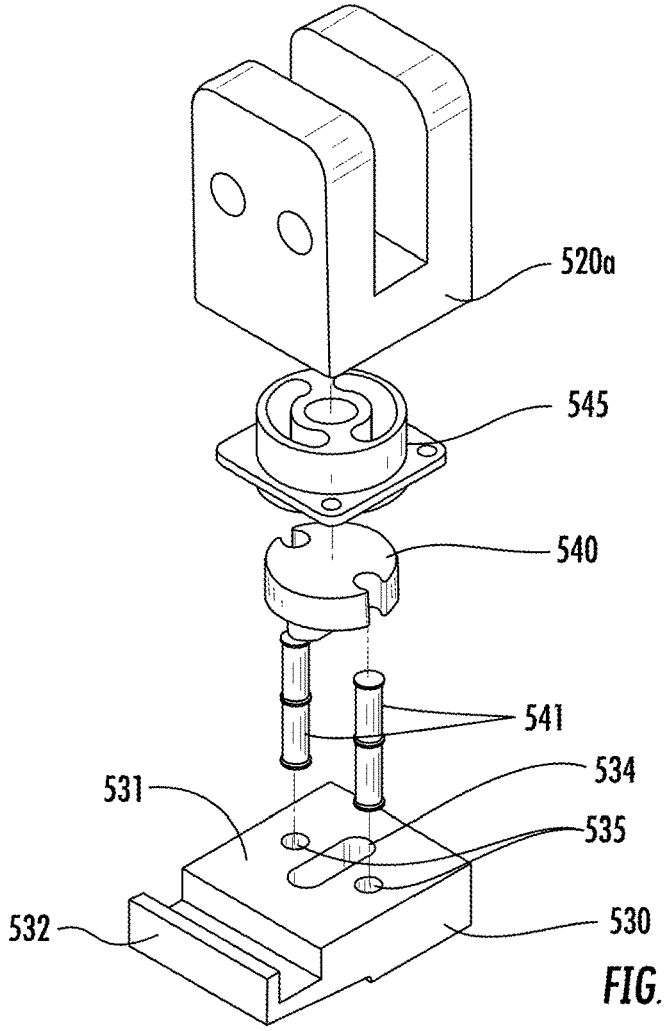
FIG. 5 is a perspective view of a pivotable clamp assembly for a lower bracket assembly according to another exemplary embodiment.

Similarly, FIG. 5 shows a pivotable clamp assembly 520 for a lower door bracket assembly, according to another exemplary embodiment. In this embodiment, the clamp 520*a*, the female member 545, the spacer 540, and the pins 541 are the same as those described above with reference to FIG. 4. The pivotable clamp assembly 520 further includes a base 530 that is similar to the base 330 of FIGS. 1C, 3A, and 3B, but includes a single flange 532 extending from a block 531. In addition, the block 531 includes a slot 534 and a pair of through holes 535 positioned adjacent the slot 534. The slot 534 is configured to receive a portion of the spacer 540. The spacer 540 is configured to be inserted into the slot 534 and to couple the pair of pins 541 to the block 531 within respective through holes 535, such that a portion of the pins 541 project (i.e., extend) upward away from the spacer 540. According to an exemplary embodiment, the pins 541 are press-fit into the respective through holes 535 of the block 531, although the pins 541 can be coupled to the block 531 in other manners (e.g., adhesives, bonding, fasteners, etc.), according to other exemplary embodiments.

Figure 6:
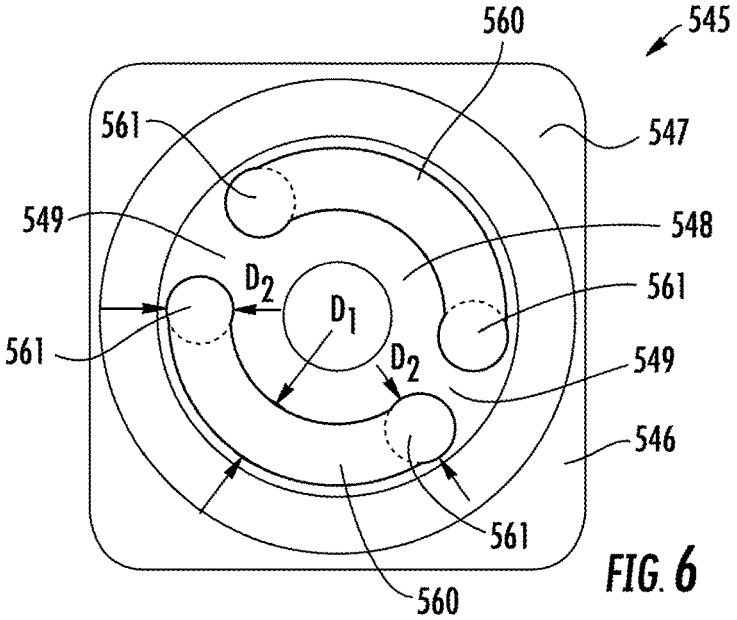
FIG. 6 is a top view of a female member for use in the pivotable clamp assemblies of FIGS. 4 and 5 according to an exemplary embodiment.

Referring now to FIG. 6, the female member 545 includes a flange 546 having a generally rectangular shape. The female member 545 also includes a hollow cylindrical portion 547. A centrally located ring 548 is disposed within the cylindrical body 547 and is connected to an inner sidewall of the body 547 via two opposing sections 549. The two opposing sections 549, the ring 548, and an inner circumferential wall of the hollow cylindrical portion 547 collectively define a pair of diametrically-opposed circumferential slots 560. The circumferential slots 560 are each configured to receive a portion of a pin 541 therein. The diameter $D_1$ of a portion of the circumferential slots 560 between the ring 548 and the inner circumferential wall is smaller than an outer diameter of the pin 541, such that at least a portion of the pin 541 interferes with and/or engages the ring 548 and the inner circumferential wall. In this way, the circumferential slots 560 provide torsional resistance when the clamp 520*a* pivots relative to either the elongated member 510 or the base 530. This interference provides the tactile feel that a user experiences, for example, when opening and/or closing a door panel 110.

As shown in FIG. 6, each of the circumferential slots 560 includes end portions 561 (i.e., where the slots terminate) at the ends of each of the circumferential slots 560. Each of the end portions 561 are defined by the opposing sections 549, a portion of the inner ring 548, and a portion of the inner circumferential wall of the cylindrical portion 547. The end portions 561 have a diameter $D_2$ that is greater than the diameter $D_1$ of the circumferential slots 560, but is substantially the same as, or is greater than, the outer diameter of the pins 541. In this way, when the clamp 520*a* is selectively rotated (i.e., pivoted) relative to the elongated member 510 or the base 530, such as when opening or closing a shower door panel 110, the pins 541 may be received within the end portions of the circumferential slots, to thereby set a rotational position of the door panel (e.g., at a fully opened or a fully closed door position). In this manner, the door panel 110 may self-lock at or bias toward a certain rotational position (e.g., a rotational end point) without the need for a separate lock or latch mechanism or element.

According to an exemplary embodiment, the female member 545 is made from a rigid or a semi-rigid material, such as a plastic (e.g., nylon, polypropylene, etc.), suitable for frictional engagement with the pins 541, to thereby provide an acceptable rotational or tactile feel of the door panel 110 when the door panel 110 is selectively pivoted. According to an exemplary embodiment, the female member 545 is made from a material that is self-lubricating or includes a lubricant (e.g., grease, oil, etc.) to provide a desired rotational or tactile feel of the door panel 110.

The various shower door assemblies disclosed herein allow for selective adjustment of the shower door position relative to a door opening (e.g., to level, to correct for out-of-plumb conditions, to adjust a horizontal position of the door, etc.), eliminate the need for separate, external stop mechanisms or latches to set a rotational position of the door (e.g., to lock or set a position of the door at a fully opened or a fully closed position), and have greater structural stability, eliminating the need for additional hardware or components typically required in similar shower door assemblies (e.g., additional brackets, gaskets, bolts, etc.).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A shower door hinge assembly, comprising:

a clamp configured to receive a portion of a shower door therein;

a member coupled to the clamp, wherein the member comprises a circumferential slot;

a base configured to be coupled to a fixed structure, wherein the base defines a hole;

a spacer coupled to the base, wherein the member is rotatably coupled to the spacer; and a pin having a first end and a second end, wherein the first end is configured to be received in the hole of the base, and wherein the second end is configured to be received in the circumferential slot;

wherein the pin and the circumferential slot are cooperatively configured to define an end point of rotation for the shower door.

2. The shower door hinge assembly of claim 1, wherein the circumferential slot includes a first portion having a first diameter, and a second portion having a second diameter that is greater than the first diameter, and wherein the second portion defines the end point for rotation of the shower door.

3. The shower door hinge assembly of claim 2, wherein the pin has a diameter that is larger than the first diameter of the first portion, so as to provide torsional resistance during rotation of the shower door.

4. The shower door hinge assembly of claim 2, wherein the member is configured to bias as the pin moves toward the second portion of the circumferential slot during rotation of the shower door.

5. The shower door hinge assembly of claim 1, wherein the member further comprises a flange received in a corresponding recess in the clamp.

6. The shower door hinge assembly of claim 1, wherein the spacer includes a projection configured to be received in the base.

7. The shower door hinge assembly of claim 1, wherein the circumferential slot is a first circumferential slot, and wherein the member further comprises a second circumferential slot that is diametrically opposed with the first circumferential slot.

8. The shower door hinge assembly of claim 7, wherein the pin is a first pin configured to be received in the first circumferential slot, and the shower door hinge assembly further comprises a second pin configured to be received in the second circumferential slot.

9. A shower door hinge assembly, comprising:

a clamp configured to receive a portion of a shower door therein;

a member coupled to the clamp, wherein the member comprises a circumferential slot;

an elongated member configured to be coupled to a fixed structure, wherein the elongated member defines a hole;

a spacer coupled to the elongated member, wherein the member is rotatably coupled to the spacer; and a pin having a first end and a second end, wherein the first end is configured to be received in the hole of the elongated member, and wherein the second end is configured to be received in the circumferential slot;

wherein the pin and the circumferential slot are cooperatively configured to define an end point of rotation for the shower door.

10. The shower door hinge assembly of claim 9, wherein the circumferential slot includes a first portion having a first diameter, and a second portion having a second diameter that is greater than the first diameter, and wherein the second portion defines the end point for rotation of the shower door.

11. The shower door hinge assembly of claim 10, wherein the pin has a diameter that is larger than the first diameter of the first portion, so as to provide torsional resistance during rotation of the shower door.

12. The shower door hinge assembly of claim 10, wherein the member is configured to bias as the pin moves toward the second portion of the circumferential slot during rotation of the shower door.

13. The shower door hinge assembly of claim 9, wherein the member further comprises a flange received in a corresponding recess in the clamp.

14. The shower door hinge assembly of claim 1, wherein the spacer includes a projection configured to be received in the elongated member.

15. The shower door hinge assembly of claim 9, wherein the circumferential slot is a first circumferential slot, and wherein the member further comprises a second circumferential slot that is diametrically opposed to the first circumferential slot.

16. The shower door hinge assembly of claim 15, wherein the pin is a first pin configured to be received in the first circumferential slot, and the shower door hinge assembly further comprises a second pin configured to be received in the second circumferential slot.

17. A shower door assembly, comprising:

a shower door; and a shower door hinge assembly for pivotably coupling the shower door to a fixed structure, the shower door hinge assembly comprising:

a clamp coupled to a portion of the shower door, wherein the portion of the shower door is received in the clamp;

a member coupled to the clamp, wherein the member comprises a circumferential slot;

a base configured to be coupled to the fixed structure, wherein the base defines a hole; and a pin having a first end and a second end, wherein the first end is configured to be received in the hole of the base, and wherein the second end is configured to be received in the circumferential slot;

wherein the pin and the circumferential slot cooperatively define an end point of rotation for the shower door.

18. The shower door hinge assembly of claim 17, wherein the circumferential slot includes a first portion having a first diameter, and a second portion having a second diameter that is greater than the first diameter, and wherein the second portion defines the end point for rotation of the shower door.

19. The shower door hinge assembly of claim 18, wherein the pin has a diameter that is larger than the first diameter of the first portion, so as to provide torsional resistance during rotation of the shower door.

20. The shower door hinge assembly of claim 18, wherein the shower door is configured to bias as the pin moves toward the second portion of the circumferential slot during rotation of the shower door.

* * * * *